US011937716B2

(12) United States Patent
Vang et al.

(10) Patent No.: US 11,937,716 B2
(45) Date of Patent: Mar. 26, 2024

(54) SIPPY CUP HAVING A SPOUTLESS TRAINING LID ASSEMBLY

(71) Applicant: Target Brands, Inc., Minneapolis, MN (US)

(72) Inventors: Kaitlin N. Vang, Ham Lake, MN (US); Sarah N. Platner, St. Anthony, MN (US); I-Heng Pan, Taipei (TW); Yisheng Lin, Guang Dong (CN)

(73) Assignee: Target Brands, Inc., Minneapolis, MN (US)

( * ) Notice: Subject to any disclaimer, the term of this patent is extended or adjusted under 35 U.S.C. 154(b) by 507 days.

(21) Appl. No.: 17/371,649

(22) Filed: Jul. 9, 2021

(65) Prior Publication Data

US 2023/0012382 A1 Jan. 12, 2023

(51) Int. Cl.
*A47G 19/22* (2006.01)
*B65D 43/02* (2006.01)
(Continued)

(52) U.S. Cl.
CPC ..... *A47G 19/2272* (2013.01); *B65D 43/0231* (2013.01); *B65D 47/043* (2013.01); *B65D 47/32* (2013.01); *B65D 2543/00046* (2013.01)

(58) Field of Classification Search
CPC ..... A47G 19/2272; A47G 19/2266; B65D 2543/00046; B65D 2543/00074;
(Continued)

(56) References Cited

U.S. PATENT DOCUMENTS 5,320,449 A 6/1994 Demarteau
5,531,353 A 7/1996 Ward et al.
(Continued)

FOREIGN PATENT DOCUMENTS

AU 2017202043 A1 4/2017
EP 3704997 A1 9/2020
(Continued)

OTHER PUBLICATIONS

U.S. Appl. No. 29/798,723, filed Jul. 9, 2021 for "Sippy Cup and Handle Base", 25 pages.
(Continued)

*Primary Examiner* — Don M Anderson
(74) *Attorney, Agent, or Firm* — Leanne Taveggia Farrell; Westman, Champlin & Koehler, P.A.

(57) ABSTRACT

A spoutless training lid assembly of a sippy cup includes a collar and a valve. The collar is configured to couple to a vessel and has an outer wall, an inner wall, an upper portion configured to be located outside the vessel and including an upper peripheral rim and a lower portion configured to be located inside the vessel and including a lower peripheral edge. The collar includes a peripheral shelf located about the inner wall. The valve is inserted into the collar and includes a flexible gasket over-molded to a rigid baffle to form a single, separable component. The gasket extends from a plate of the baffle and terminates at an outer peripheral edge that engages with the rim of the collar. The baffle secures to the shelf and portions of a perimeter edge of the plate of the baffle abut the inner wall of the collar.

20 Claims, 18 Drawing Sheets

(51) Int. Cl.
*B65D 47/04* (2006.01)
*B65D 47/32* (2006.01)

(58) Field of Classification Search
CPC ..... B65D 2543/00231; B65D 43/0231; B65D 47/043; B65D 47/32; B65D 51/18; B65D 51/24; B65D 51/28
See application file for complete search history.

(56) References Cited

U.S. PATENT DOCUMENTS 5,890,619 A 4/1999 Belanger
6,102,245 A 8/2000 Haberman
6,116,457 A 9/2000 Haberman
6,202,877 B1 3/2001 La Torre et al.
D448,242 S 9/2001 McDonough et al.
D448,976 S 10/2001 McDonough et al.
D450,535 S 11/2001 McDonough et al.
D452,116 S 12/2001 McDonough et al.
D452,415 S 12/2001 McDonough et al.
D463,216 S 9/2002 McDonough et al.
6,568,557 B2 5/2003 Fusco et al.
D476,849 S 7/2003 Randolph
6,758,364 B1 7/2004 Rohrig
D579,722 S 11/2008 Sakulsacha et al.
7,549,556 B2 * 6/2009 Miller ..... A47G 19/2272 220/717
7,575,126 B2 8/2009 Kemper
D616,706 S 6/2010 Bofinger et al.
D619,851 S 7/2010 Miller et al.
D636,634 S 4/2011 Kemper et al.
D642,867 S 8/2011 Miller et al.
8,025,178 B2 9/2011 Miller
D649,835 S 12/2011 Lim
D663,038 S 7/2012 Enghard
D667,558 S 9/2012 Hakim
8,272,525 B1 9/2012 La Torre et al.
D671,793 S 12/2012 Hakim
8,333,299 B2 12/2012 Kemper et al.
D676,709 S 2/2013 Thomas
8,453,870 B2 6/2013 Berg
D698,600 S 2/2014 Aslan
8,739,993 B2 6/2014 Dunn et al.
D710,147 S 8/2014 Saxton
D720,464 S 12/2014 Prentice et al.
D724,233 S 3/2015 Moore et al.
D731,857 S 6/2015 Saxton et al.
D734,109 S 7/2015 Goodman et al.
D735,577 S 8/2015 Lee
9,138,088 B2 9/2015 Kemper et al.
D741,658 S 10/2015 Dunn et al.
D744,281 S 12/2015 Dunn et al.
D746,109 S 12/2015 Wilson et al.
9,204,746 B2 12/2015 Trudeau et al.
9,241,588 B2 1/2016 Dunn et al.
D749,745 S 2/2016 Prentice et al.
D750,439 S 3/2016 Saxton et al.
D750,490 S 3/2016 Moore et al.
9,504,342 B2 11/2016 Chan et al.
D783,358 S 4/2017 Schlegel et al.
D785,807 S 5/2017 Saadia
9,661,954 B2 5/2017 Chan
D793,167 S 8/2017 Schlegel et al.
D795,064 S 8/2017 Moore et al.
9,801,481 B2 10/2017 Dunn et al.
D807,692 S 1/2018 Yao
D810,500 S 2/2018 Maple
9,888,796 B2 2/2018 Dunn et al.
D818,133 S 5/2018 Moore et al.
D820,085 S 6/2018 Moore et al.
D824,720 S 8/2018 Gagnon et al.
D830,767 S 10/2018 Gordon
10,165,878 B2 1/2019 Dunn et al.
10,213,034 B2 2/2019 Zhang et al.
10,239,647 B2 3/2019 Wilson
D847,560 S 5/2019 Calland
D847,642 S 5/2019 Dunn et al.
10,285,520 B2 5/2019 Dunn et al.
D850,208 S 6/2019 Han
10,364,072 B2 7/2019 Tebbe et al.
10,443,665 B2 10/2019 Kastner et al.
D867,813 S 11/2019 Reed
10,464,722 B2 * 11/2019 Cudworth ..... A47G 19/2266
10,486,925 B2 11/2019 Dunn et al.
D869,669 S 12/2019 Lv
10,493,002 B2 12/2019 Chan et al.
10,494,211 B2 12/2019 Dunn et al.
10,507,969 B2 12/2019 Fang et al.
D873,426 S 1/2020 Tyler
D873,621 S 1/2020 Egorov et al.
10,531,725 B2 1/2020 Birkert et al.
10,548,428 B2 2/2020 Kollep et al.
10,589,712 B2 3/2020 Kang et al.
10,603,249 B2 3/2020 Fang et al.
10,618,727 B2 4/2020 Lee et al.
10,618,729 B1 4/2020 Dunn et al.
10,625,921 B2 4/2020 Johnson et al.
10,631,676 B2 4/2020 Hakim
10,654,627 B2 5/2020 Feeley et al.
D898,519 S 10/2020 Renz
10,799,046 B2 10/2020 Zhang et al.
10,827,860 B2 11/2020 Dunn et al.
10,881,228 B2 1/2021 Miller et al.
D911,534 S 2/2021 Cannon et al.
2002/0010026 A1 1/2002 York
2004/0045923 A1 3/2004 Lancesseur et al.
2004/0045972 A1 3/2004 Stokes
2004/0237573 A1 12/2004 Jagger et al.
2004/0250567 A1 12/2004 Jagger et al.
2005/0056653 A1 * 3/2005 Miller ..... A47G 19/2272 220/711
2006/0016820 A1 1/2006 Himes et al.
2006/0169694 A1 8/2006 Kemper
2009/0165199 A1 7/2009 Heumann
2011/0084084 A1 4/2011 Berg
2012/0305577 A1 12/2012 Dunn et al.
2012/0305581 A1 12/2012 Dunn et al.
2012/0305582 A1 12/2012 Dunn et al.
2013/0306667 A1 11/2013 Chan
2015/0014268 A1 1/2015 Rhodes et al.
2015/0079648 A1 3/2015 Border
2016/0106628 A1 4/2016 Kemper et al.
2017/0013985 A1 1/2017 Fan
2017/0095406 A1 4/2017 Hakim
2017/0210516 A1 7/2017 Tebbe et al.
2017/0245730 A1 8/2017 Dunn et al.
2017/0295968 A1 10/2017 Dunn et al.
2018/0042415 A1 2/2018 Dunn et al.
2018/0093236 A1 4/2018 Johnson et al.
2018/0099805 A1 4/2018 Johnson et al.
2018/0194524 A1 * 7/2018 Chalermwinsuekun ..... A47G 19/2272
2018/0220715 A1 8/2018 Bisson et al.
2018/0237213 A1 8/2018 Fang et al.
2018/0344064 A1 12/2018 Miller et al.
2019/0021532 A1 1/2019 Dunn et al.
2019/0177082 A1 6/2019 Lee et al.
2020/0154916 A1 * 5/2020 Cudworth ..... A47G 19/2272
2020/0229625 A1 7/2020 Holschumacher et al.
2020/0359816 A1 * 11/2020 Renz ..... A47G 19/2272
2021/0052094 A1 2/2021 Dunn et al.
2022/0061562 A1 * 3/2022 Dobrusskin ..... A47G 19/2272
2023/0095110 A1 * 3/2023 Dobrusskin ..... A47G 19/2266 220/711
2023/0234758 A1 * 7/2023 Jagger ..... B65D 1/32 220/203.01

FOREIGN PATENT DOCUMENTS

GB 2562280 A 11/2018
WO 2015057871 A1 4/2015
WO 2020095011 A1 5/2020
WO 2020107064 A1 6/2020

(56) References Cited

FOREIGN PATENT DOCUMENTS

OTHER PUBLICATIONS

Admar International—Nuby 360 Wonder cup, https://www.nuby.com/usa/en/360°-wonder-cup, at least as early as May 4, 2020, 1 page.
The First Years, Inc. or Tomy International, Inc.—The First Years Simply Spoutless Cup, https://us.tomy.com/products/disney-mickeymouse-simplyspoutless-cup, at least as early as May 4, 2020, 1 page.
The First Years Simply Spoutless Cup, https://us.tomy.com/products/disney-mickey-mousesimply-spoutless-cup-9-oz, at least as early as Mar. 16, 2021, 1 page.
Kids Brands or Sassy, Inc.—Sassy 360 Grow up Cup, https://www.sassybaby.com/product/9-oz-cup-2-pack, at least as early as May 4, 2020, 1 page.
Mayborn—Tommee Tippee Easiflow 360, https://www.tommeetippee.com/enus/product/easiflow-360-cup-1, at least as early as May 4, 2020, 1 page.
Nuby 360 Wonder Cup, https://www.nuby.com/usa/en/360%C2%BA-wonder-cup-3, at least as early as Mar. 16, 2021, 1 page.
Nuk—Learner Cup, https://www.nuk-usa.com/cups/trainer-cups/learner-cup/SAP_2140455.html, at least as early as Jul. 7, 2021, 1 page.
Sassy Grow Up Cup 360, https://www.sassybaby.net/feeding/p/12oz-360-tritangrow-up-cup, at least as early as Mar. 16, 2021,1 page.
Sophie La Girafe—Non-Spill Cup, https://sophielagirafe.co.uk/sophie-la-girafe-non-spill-cup-492-p.asp, at least as early as Jul. 7, 2021, 1 page.

* cited by examiner

SIPPY CUP HAVING A SPOUTLESS TRAINING LID ASSEMBLY

BACKGROUND

Sippy or training cups are drinking cups designed for toddlers as an intermediary between transitions from a bottle or nursing to an open cup. To prevent or reduce spills, sippy cups often have a lid with either a spout or straw that the child drinks through. Generally the reduction in spills is accomplished by way of surface tension or a valve that prevents liquid from spilling when the cup is upended.

The discussion above is merely provided for general background information and is not intended to be used as an aid in determining the scope of the claimed subject matter. The claimed subject matter is not limited to implementations that solve any or all disadvantages noted in the background.

SUMMARY

A sippy cup has a spoutless training lid assembly. The spoutless training lid assembly includes a collar and a valve. The collar is configured to couple to a vessel and has an outer wall, an inner wall, an upper portion configured to be located outside of the vessel and including an upper peripheral rim and a lower portion configured to be located inside of the vessel and including a lower peripheral edge. The collar includes a peripheral shelf located about the inner wall. The valve is inserted into the collar and includes a flexible gasket over-molded to a rigid baffle to form a single, separable component. The gasket extends from a plate of the baffle and terminates at an outer peripheral edge that sealably engages with the upper peripheral rim of the collar. The baffle is secured to the peripheral shelf of the collar and portions of a perimeter edge of the plate of the baffle abut the inner wall of the collar.

A sippy cup has a spoutless training lid assembly. The spoutless training lid assembly includes a collar, a valve and an external housing. The collar is configured to be coupled to a vessel and has an outer wall, an inner wall, an upper portion configured to be located outside of the vessel and including an upper peripheral rim and a lower portion configured to be located inside of and including a lower peripheral edge. The valve is inserted into and secured to the collar. The external housing is located on the outer wall of the upper portion of the collar and includes a through hole. The through hole is configured to receive a clip or tether.

A sippy cup includes a vessel and a spoutless training lid assembly coupled to the vessel. The spoutless training lid assembly includes a valve inserted into and secured in a collar. The valve includes a gasket over-molded to a baffle and an outer peripheral edge of the gasket being sealed to a rim of the collar. The sippy cup is configured to be tilted so that liquid flows from the vessel through a plurality spaced apart cut-outs in a perimeter edge of a plate of the baffle into a cavity located between a wall of the gasket, the plate of the baffle and an inner wall of the collar. A drinking force is configured to be applied to the rim of the collar of the spoutless training lid assembly such that the outer peripheral edge of the gasket lifts away from the rim of the collar to allow the liquid to flow from the cavity and out of the sippy cup.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

DETAILED DESCRIPTION

A sippy cup having a spoutless training lid assembly is provided that is spill proof and interchangeable with other types of spill proof lids on a vessel. The spoutless training lid assembly includes a valve that covers the top opening of the vessel and seals to the entire perimeter of the upper rim of the lid assembly. With a spoutless training lid assembly attached to a vessel, a child may tilt the sippy cup and mimic the way a person would drink from an open top cup. Such drinking ergonomics helps support the normal muscle development of a child's mouth rather than the muscles used from sucking a bottle or from nursing. The spoutless training lid assembly is removable from the vessel and includes two separable components for washing. The two components include a collar and a valve.

Figure 1:
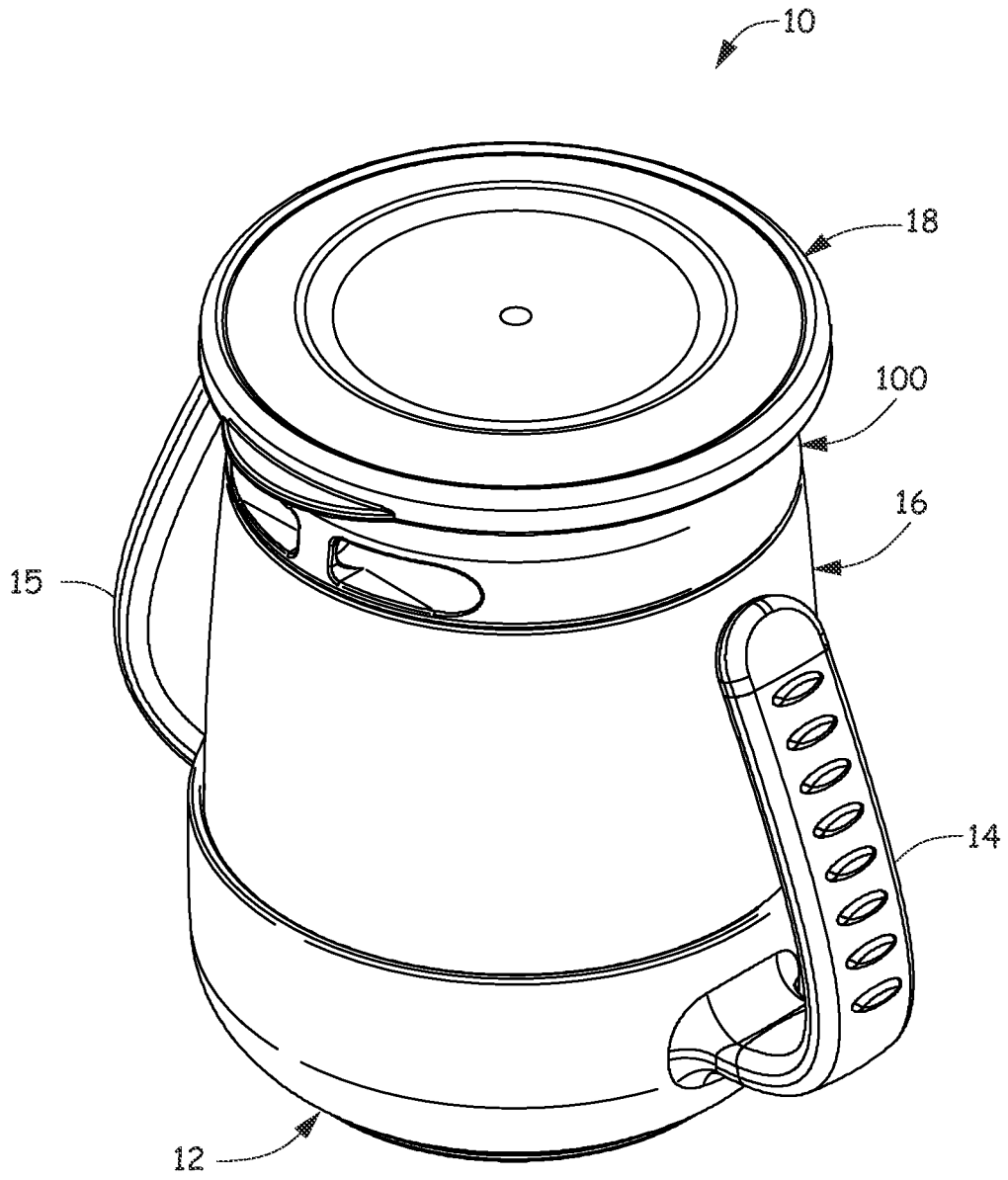
FIG. 1 is a perspective view of an assembled sippy cup according to an embodiment.
Figure 2:
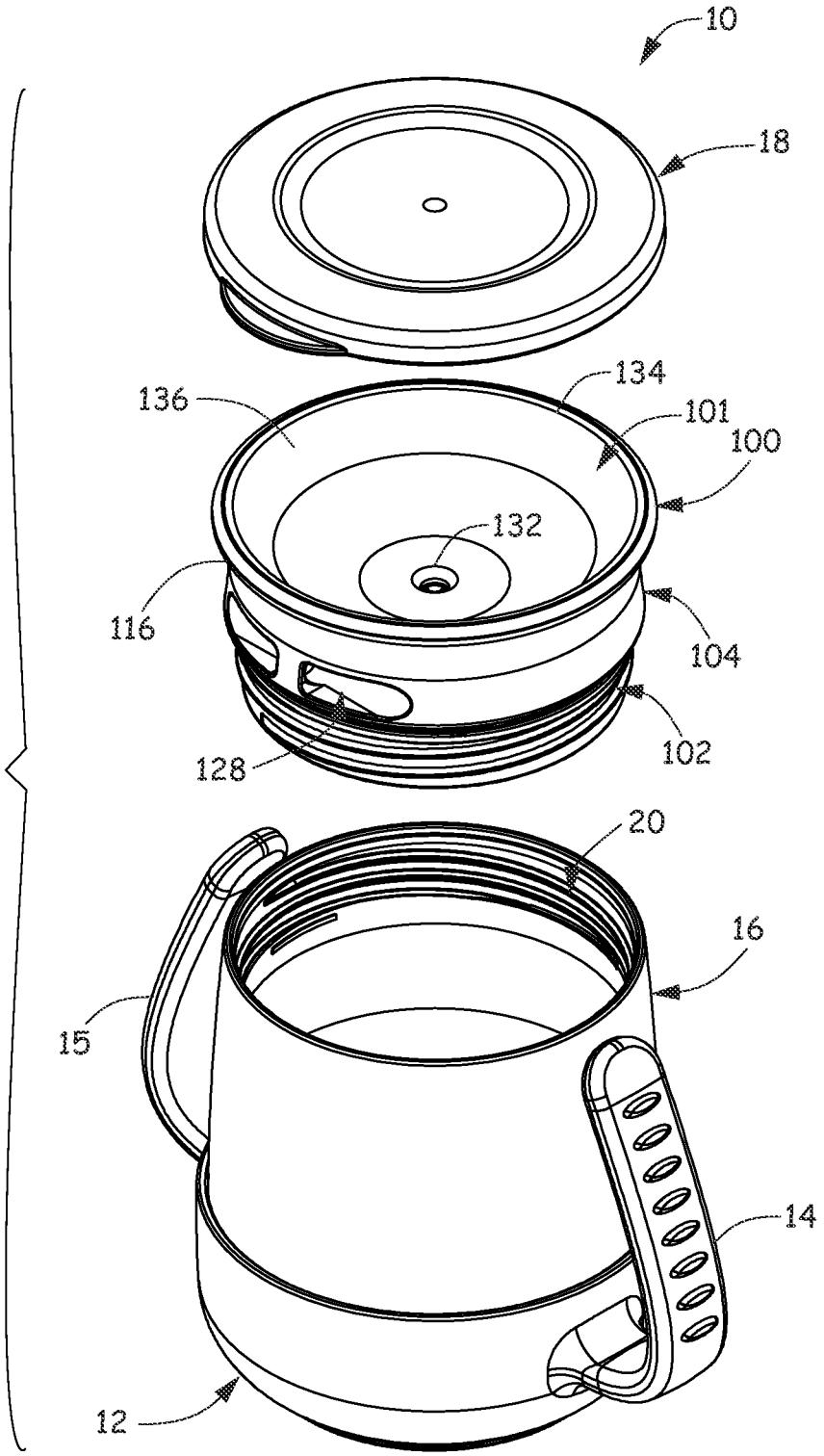
FIG. 2 is an exploded perspective view of the sippy cup of FIG. 1.

FIG. 1 is a perspective view of an assembled sippy cup 10 according to an embodiment. FIG. 2 is an exploded perspective view of sippy cup 10. Sippy cup 10 includes spoutless training lid assembly 100, a vessel 16, a cap 18 and a removable base 12 having handles 14 and 15. Under various embodiments, vessel 16 may have a degree of transparency and include an internally threaded portion 20 having internally projecting threads, while spoutless training lid assembly 100 may include externally projecting threads 102. Externally projecting threads 102 of spoutless training lid assembly 100 are configured to mate with internally projecting threads 20 of vessel 16.

Figure 3:
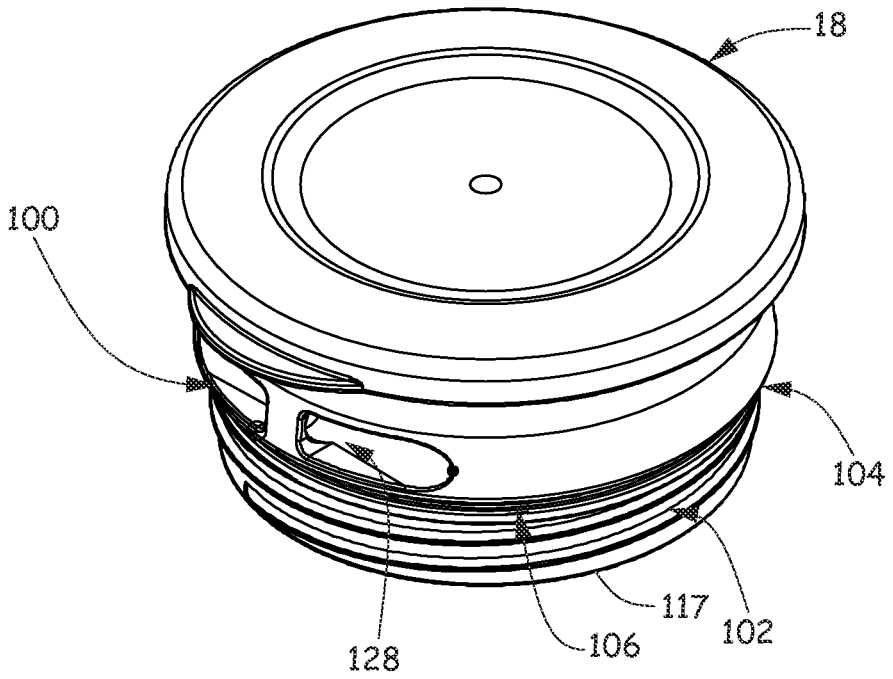
FIG. 3 is a perspective view of a spoutless training lid assembly and a cap of the FIG. 1 sippy cup.
Figure 4:
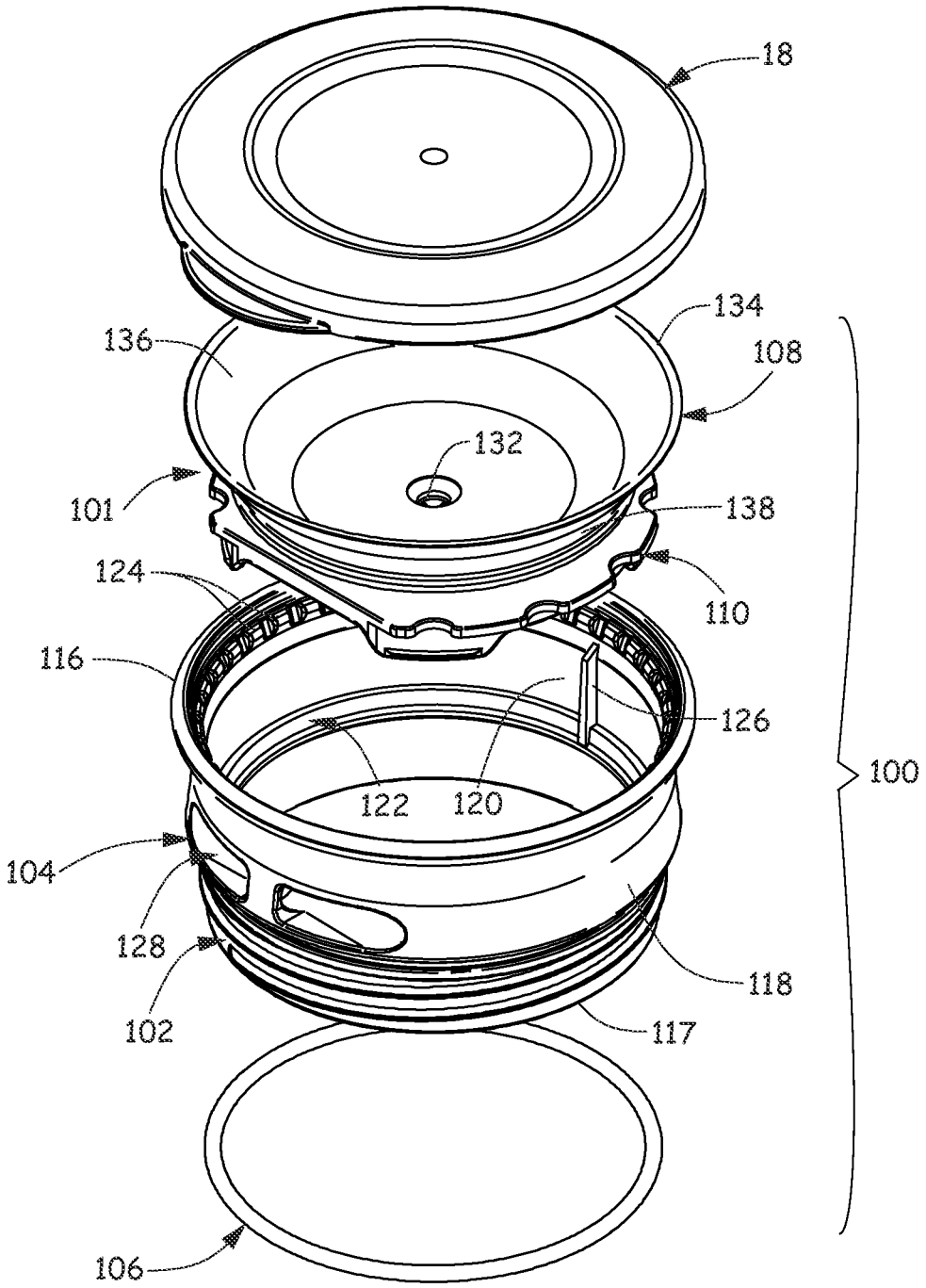
FIG. 4 is an exploded perspective view of the spoutless training lid assembly and cap of FIG. 3.
Figure 5:
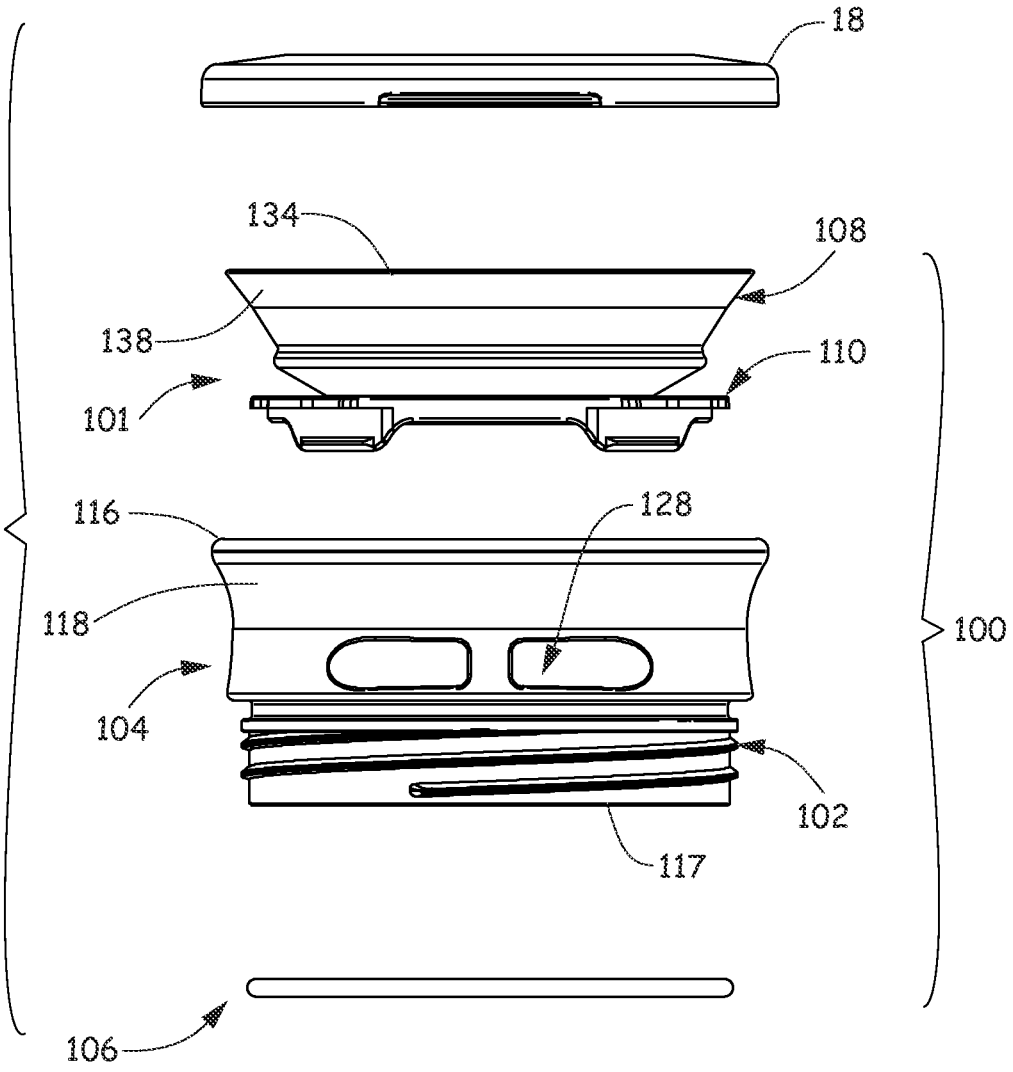
FIG. 5 is an exploded front view of the spoutless training lid assembly and cap of FIG. 3.
Figure 6:
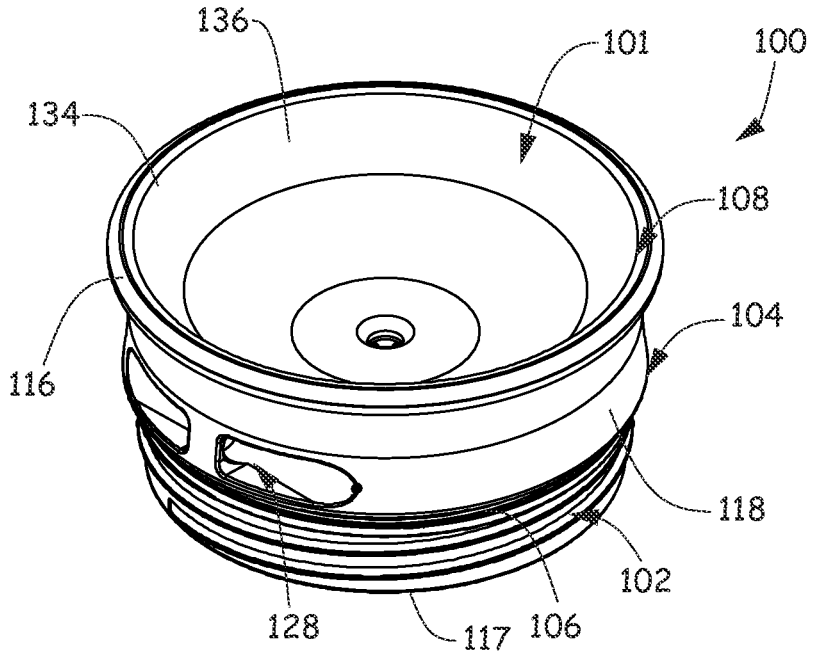
FIG. 6 is a perspective view of the spoutless training lid assembly of FIG. 1 without the cap.
Figure 7:
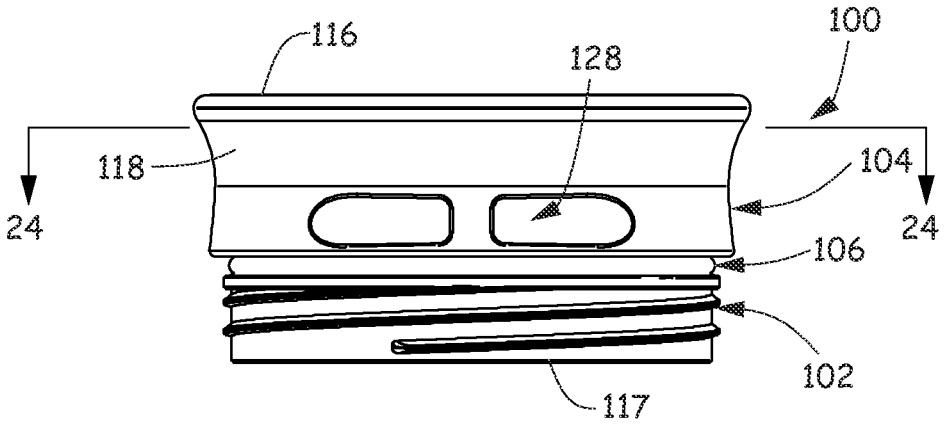
FIG. 7 is a front view of the spoutless training lid assembly of FIG. 6.
Figure 8:
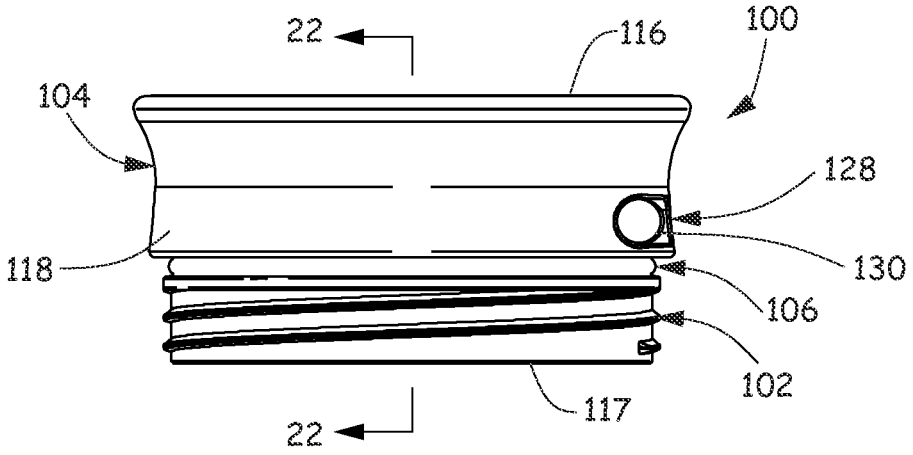
FIG. 8 is a left side view of the spoutless training lid assembly of FIG. 6.
Figure 9:
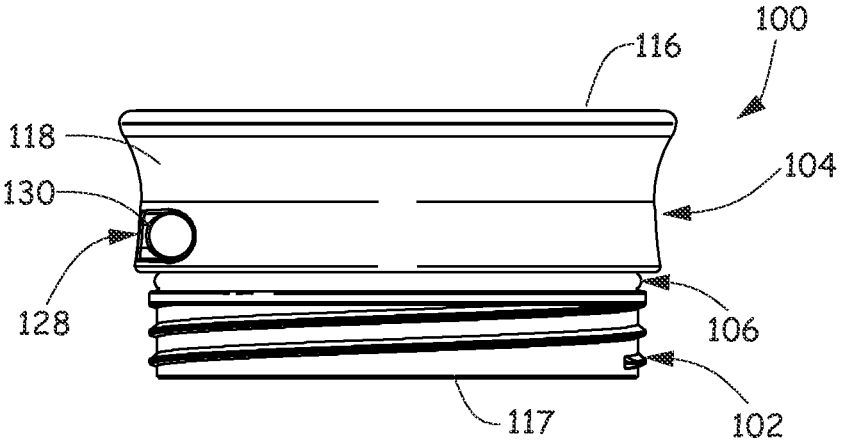
FIG. 9 is a right side view of the spoutless training lid assembly of FIG. 6.
Figure 10:
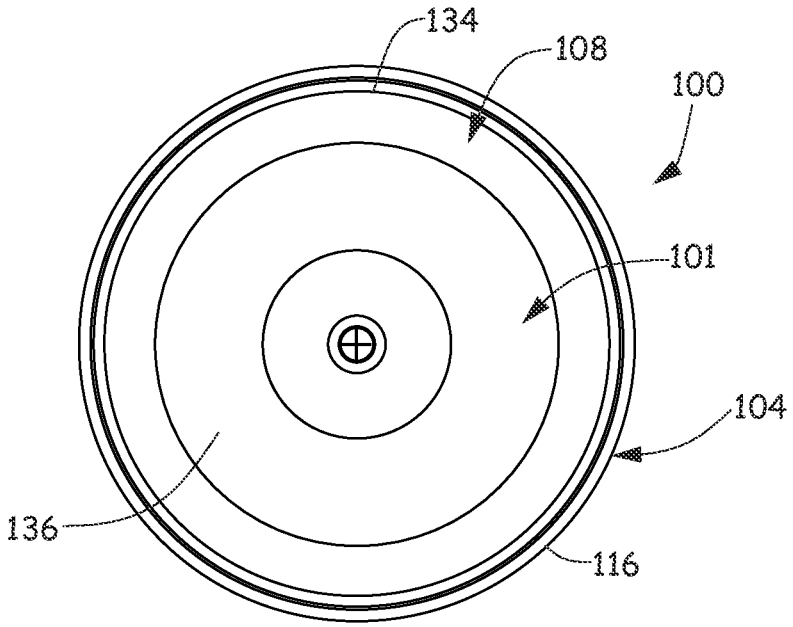
FIG. 10 is a top view of the spoutless training lid assembly of FIG. 6.
Figure 11:
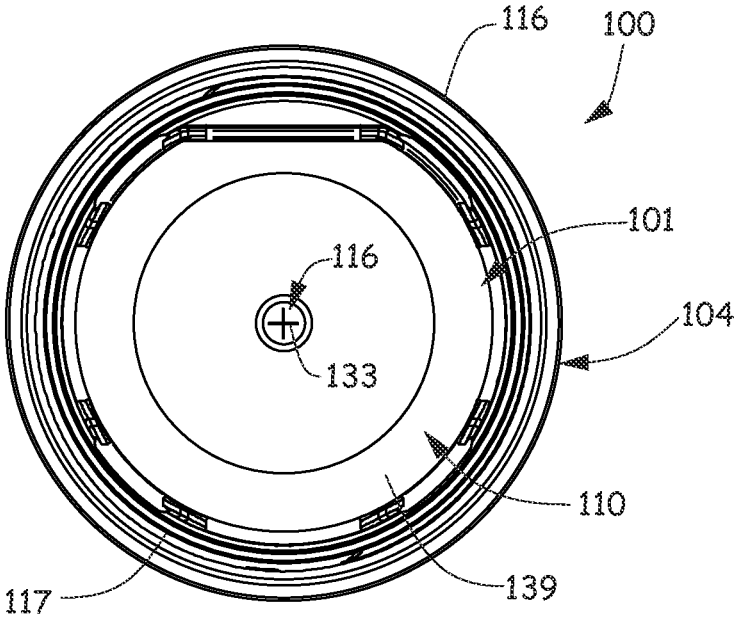
FIG. 11 is a bottom view of the spoutless training lid assembly of FIG. 6.

FIG. 3 is a perspective view of spoutless training lid assembly 100 and cap 18. FIG. 4 is an exploded perspective view of FIG. 3 and FIG. 5 is an exploded front view of FIG. 3. FIG. 6 is a perspective view of spoutless training lid assembly 100 without cap 18. FIG. 7 is a front view, FIG. 8 is a left side view, FIG. 9 is a right side view, FIG. 10 is a top view and FIG. 11 is a bottom view of FIG. 6. Spoutless training lid assembly 100 includes a valve 101, a collar 104 and an o-ring 106.

Valve 101 includes a gasket 108 over-molded to a baffle 110 to form a single, seperable component. In one embodiment, gasket 108 is made of a flexible material, such as liquid silicone, and is over-molded to baffle 110 with, for example, liquid silicone. Baffle 110 is made of a rigid material, such as polyphenylsulfone (PPSU). Therefore, valve 101 is a single, separable component made by way of an over-mold of two parts. In one embodiment, collar 104 is made of a rigid material, such as polypropylene (PP). In one embodiment, o-ring 106 is made of a flexible material, such as rubber.

Figure 12:
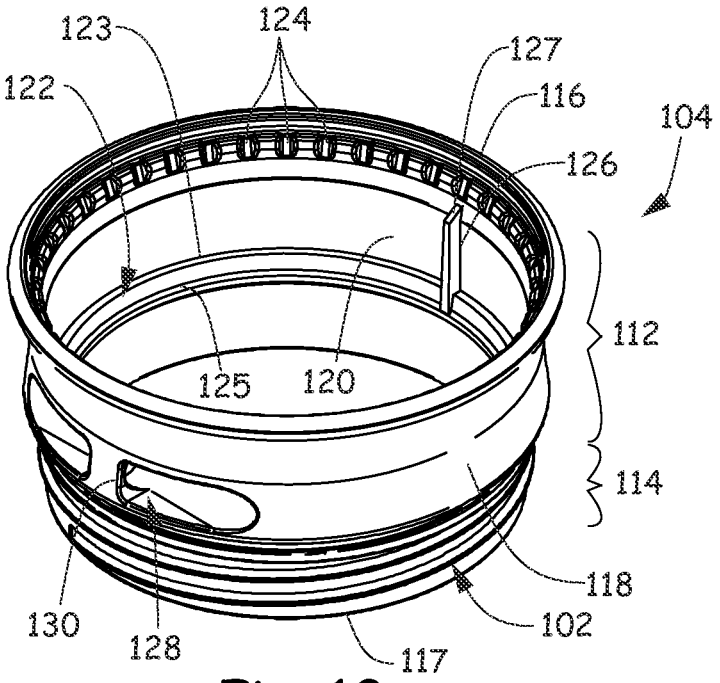
FIG. 12 is a front perspective view of a collar of the spoutless training lid assembly according to an embodiment.
Figure 13:
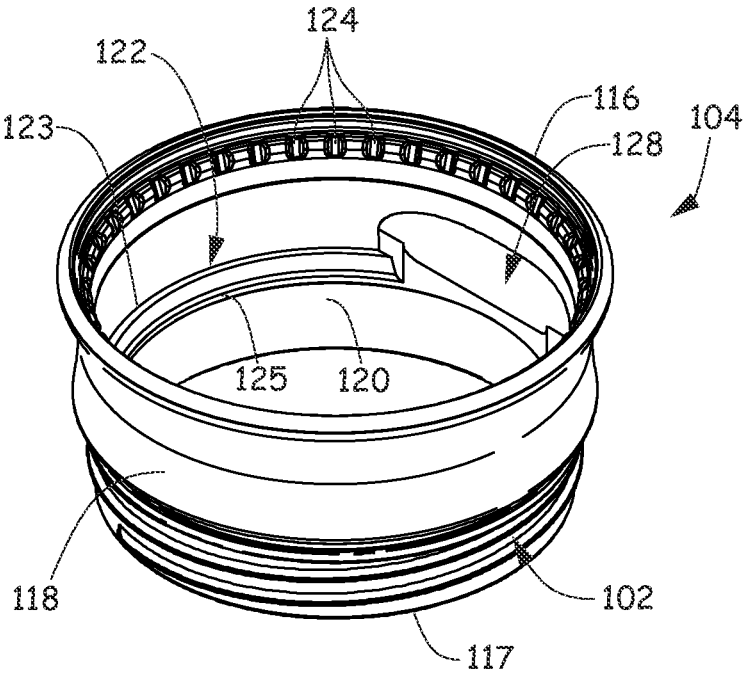
FIG. 13 is back perspective view of the collar of FIG. 12.
Figure 14:
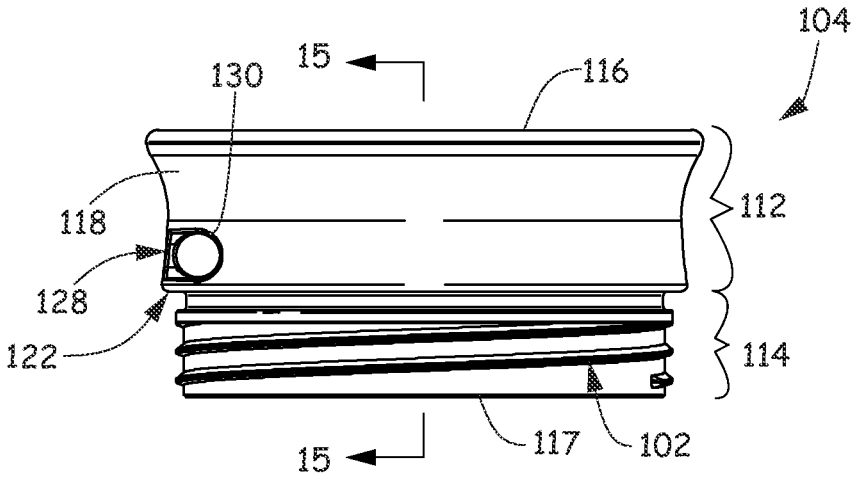
FIG. 14 is a right side view of the collar of FIG. 12.
Figure 15:
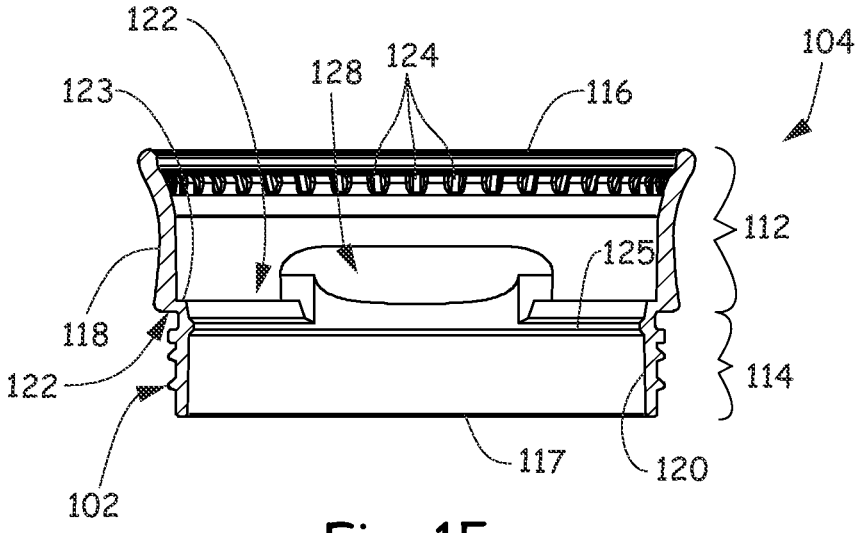
FIG. 15 section view of the collar taken through the section line indicated in FIG. 14.

FIG. 12 is a front perspective view of collar 104 according to an embodiment, FIG. 13 is a back perspective view, FIG. 14 is a right side view and FIG. 15 is a section view taken through the section line indicated in FIG. 14. Collar 104 includes an upper portion 112 and a lower portion 114. Upper portion 112 is configured to be located outside of vessel 16 when collar 104 is coupled to vessel 16, while lower portion 114 is configured to be located inside vessel 16 when collar 104 is coupled to vessel 16. Upper portion 112 has an upper peripheral rim 116 and lower portion 114 has a lower peripheral edge 117.

Collar 104 includes an outer wall 118, an inner wall 120 and a peripheral shelf 122 located at a transition between lower portion 114 and upper portion 112. Outer wall 118 extends substantially vertically from lower peripheral edge 117 along lower portion 114 and provides externally threaded portion 102 about a periphery of lower portion 114 of outer wall 118. Outer wall 118 then steps outwardly at shelf 122 and follows a smooth concave extending peripheral curve along upper portion 112 and rounds to upper peripheral rim 116. Inner wall 120 extends substantially vertically from lower peripheral edge 117 along lower portion 114, steps outwardly at shelf 122, follows a smooth convex extending peripheral curve along upper portion 112 and intersects with outer wall 118 at upper peripheral rim 116. Peripheral shelf 122 includes an upper lip 123 and a lower lip 125. Inner wall 120 further includes a plurality of spaced apart peripheral protrusions 124 that extend internally from internal wall 120. Protrusions 124 are located between upper lip 123 of shelf 122 and rim 116 but closer to rim 116 than upper lip 123 of shelf 122.

Collar 104 further includes a vertically oriented guide flange 126 and an external housing 128. Guide flange 126 protrudes from inner wall 120 and extends from lower lip 125 of shelf 122, through upper lip 123, along upper portion 112 and terminates at a tapered end 127 that is located below upper peripheral rim 116 and the plurality of peripheral protrusions 124. Opposite to guide flange 126 is external housing 128. External housing 128 is located on outerwall 118 of upper portion 112 of collar 104 and includes a through hole 130. Through hole 130 is configured to receive a clip, a tether or the like. To provide external housing 128, housing 128 protrudes internally in collar 104 from inner wall 120 to house through hole 130, and is flush with outer wall 118.

Figure 16:
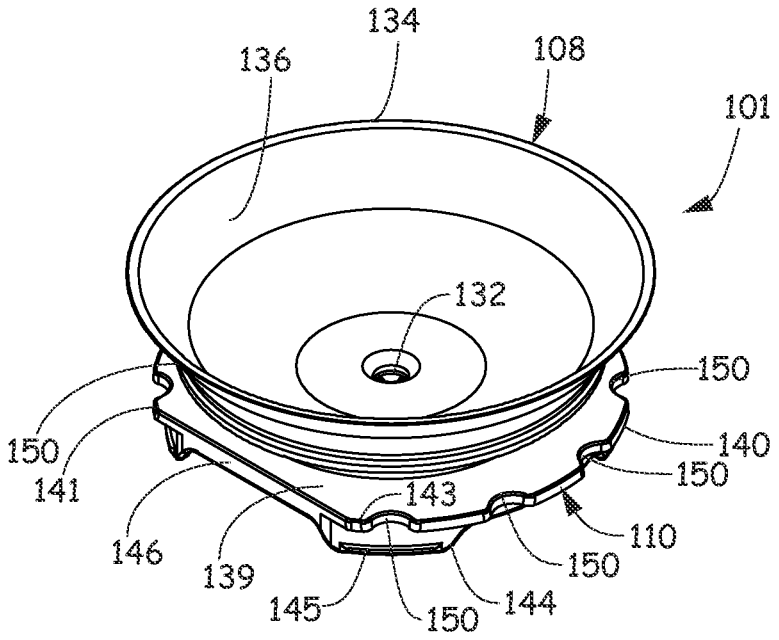
FIG. 16 is a front perspective view of a valve of the spoutless training lid assembly according to an embodiment.
Figure 17:
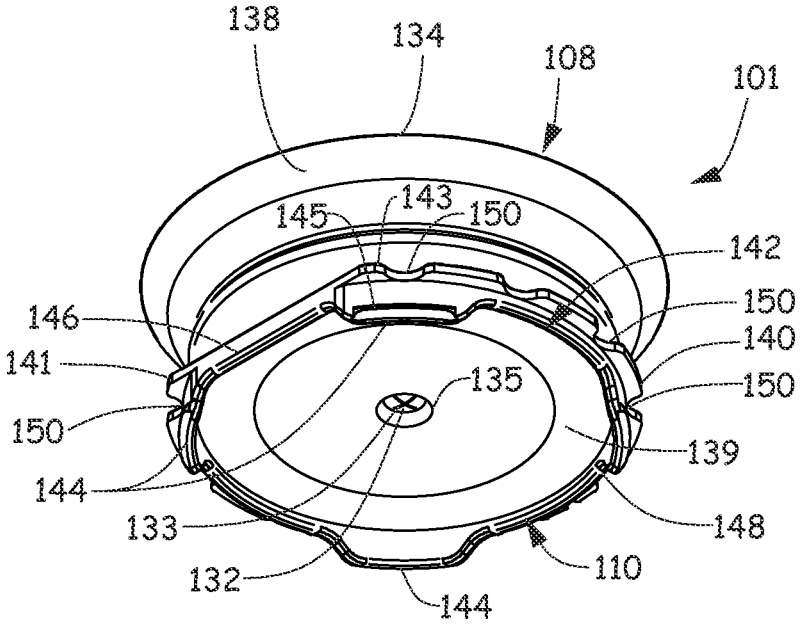
FIG. 17 is a bottom perspective view of the valve of FIG. 16.
Figure 18:
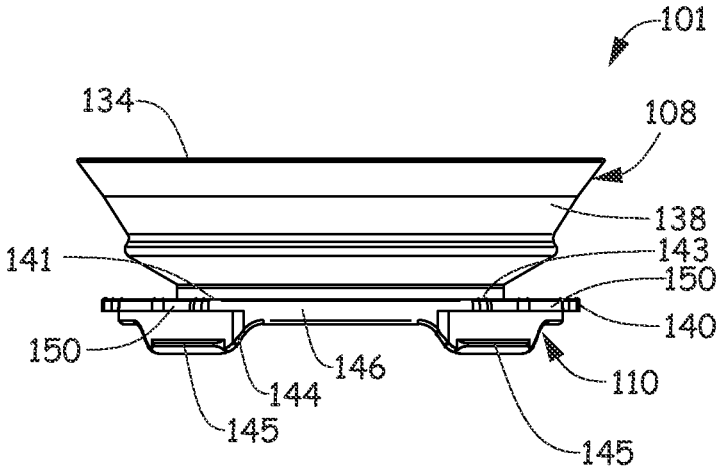
FIG. 18 is a front view of the valve of FIG. 16.
Figure 19:
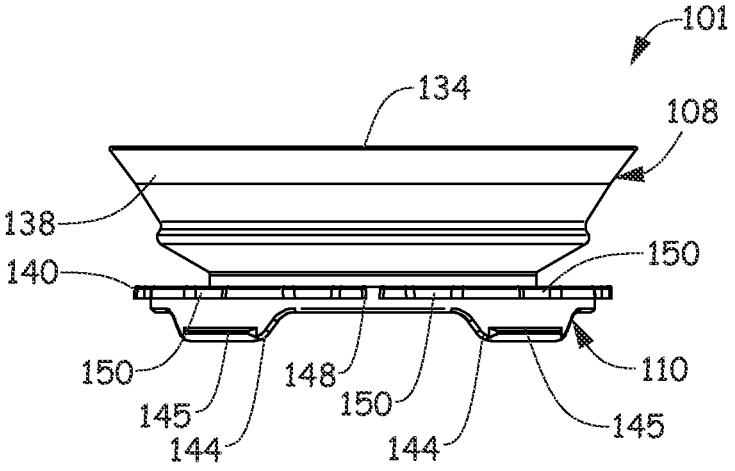
FIG. 19 is a back view of the valve of FIG. 16.
Figure 20:
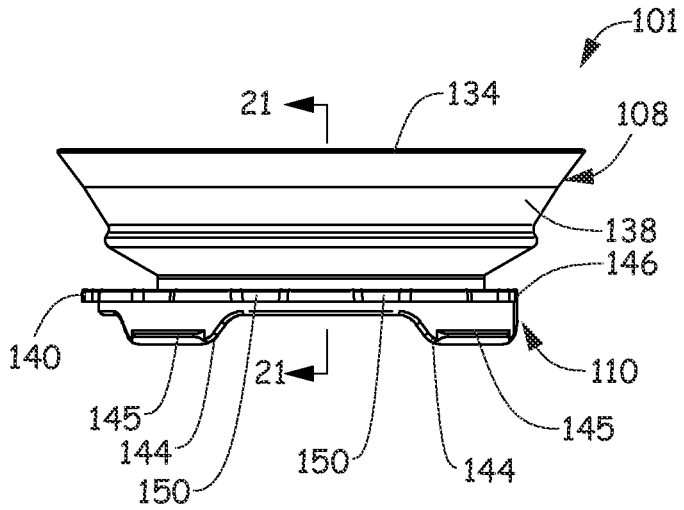
FIG. 20 is a left side view of the valve of FIG. 16.
Figure 21:
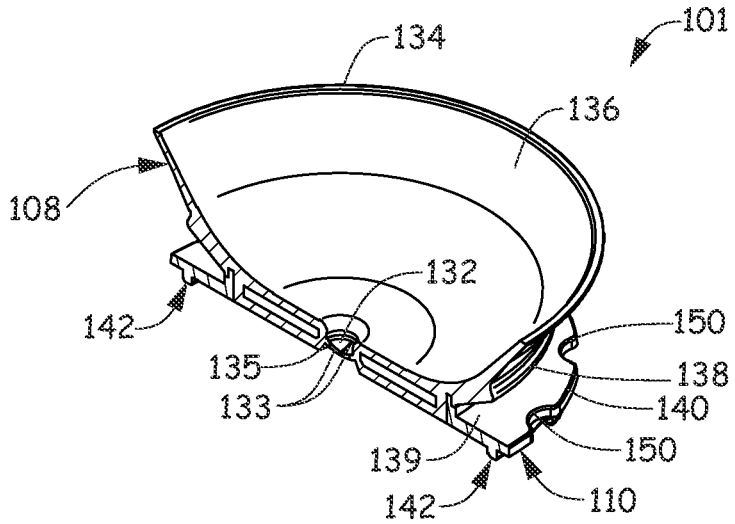
FIG. 21 is a perspective section view of the valve taken through the section line indicated in FIG. 20.

FIG. 16 is a front perspective view of valve 101 according to an embodiment, FIG. 17 is a bottom perspective view, FIG. 18 is a front view, FIG. 19 is a back view, FIG. 20 is a left side view and FIG. 21 is a perspective section view taken through the section line indicated in FIG. 20. As previously discussed, valve 101 includes gasket 108 over-molded to baffle 110. Gasket 108 has a resiliently deformable body having a center dimple 132. Center dimple 132 is aligned with an aperture 135 in a plate 139 of baffle 110 and includes through slits 133 formed into the shape of cross-hairs. Through slits 133 provide a vent between vessel 16 and an exterior environment. Gasket 108 includes a continuous concave-shaped exterior facing wall 136 that extends peripherally from center dimple 132 to an outer peripheral edge 134 and an opposing continuous convex-shaped interior facing wall 138 that extends peripherally to outer peripheral edge 134. Together exterior facing wall 136, opposing interior facing wall 138, center dimple 132 and outer peripheral edge 134 of gasket 108 form a frusto-conical shape.

As previously described, baffle 110 includes substantially disc-shaped plate 139 having a perimeter edge 140 and a cylindrical shaft 142 extending from and below the disc-shaped plate 139. Cylindrical shaft 142 includes a plurality of downward depending flange members 144 evenly spaced apart around the perimeter of cylindrical shaft 142. Each downward depending flange member 144 includes a rib 145.

Perimeter edge 140 of plate 139 includes a plurality of features. On a front side of plate 139, perimeter edge 140 includes a straight edge 146 that extends from a first point on perimeter edge 140 to a second point 143 on perimeter edge 140. Straight edge 146 accommodates the internally protruding housing 128 that houses through hole 130. Straight edge 146 is positioned adjacent housing 128 on inner wall 120 of collar 104. On an opposing back side of plate 139, perimeter edge 140 includes a notch 148. Notch 148 is configured to mate with guide flange 126 that protrudes from inner wall 120 of collar 104 so as to ensure that valve 101 is properly assembled into upper portion 112 of collar 104. Still further, perimeter edge 140 includes a plurality of spaced apart cut-outs 150 that are evenly arranged about the remaining portions of perimeter edge 140. In particular, cut-outs 150 are located between first point 141 and notch 148 and notch 148 and second point 143. Cut-outs 150 have curved surfaces and when valve 101 is inserted into collar 104 and collar 104 is secured to vessel 16, perimeter edge 140 of plate 139 abuts inner wall 120 of collar 104, cut-outs 150 provide openings extending through plate 139 to allow liquid in vessel 16 to be directed into a cavity inside upper portion 112 of collar 104 between baffle 110, inner wall 120 of collar 104 and interior facing wall 138 of gasket 108.

Figure 22:
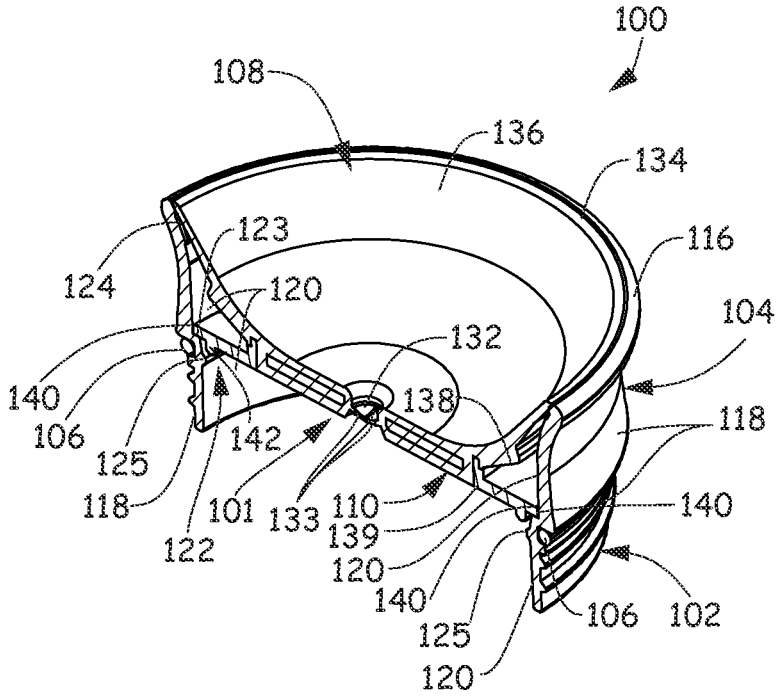
FIG. 22 is a perspective section view of the spoutless training lid assembly taken through the section line indicated in FIG. 8.
Figure 23:
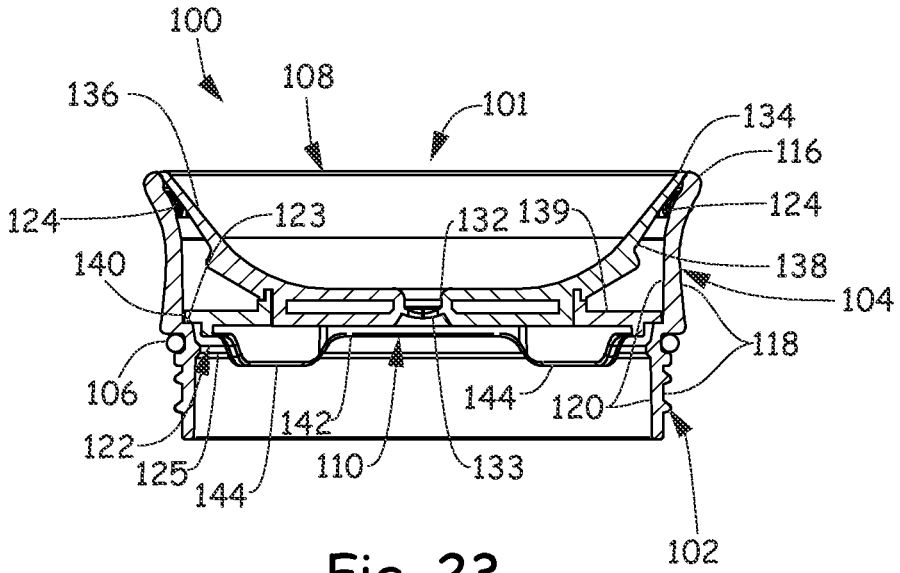
FIG. 23 is a front view of the section view of the spoutless training lid assembly in FIG. 22.
Figure 24:
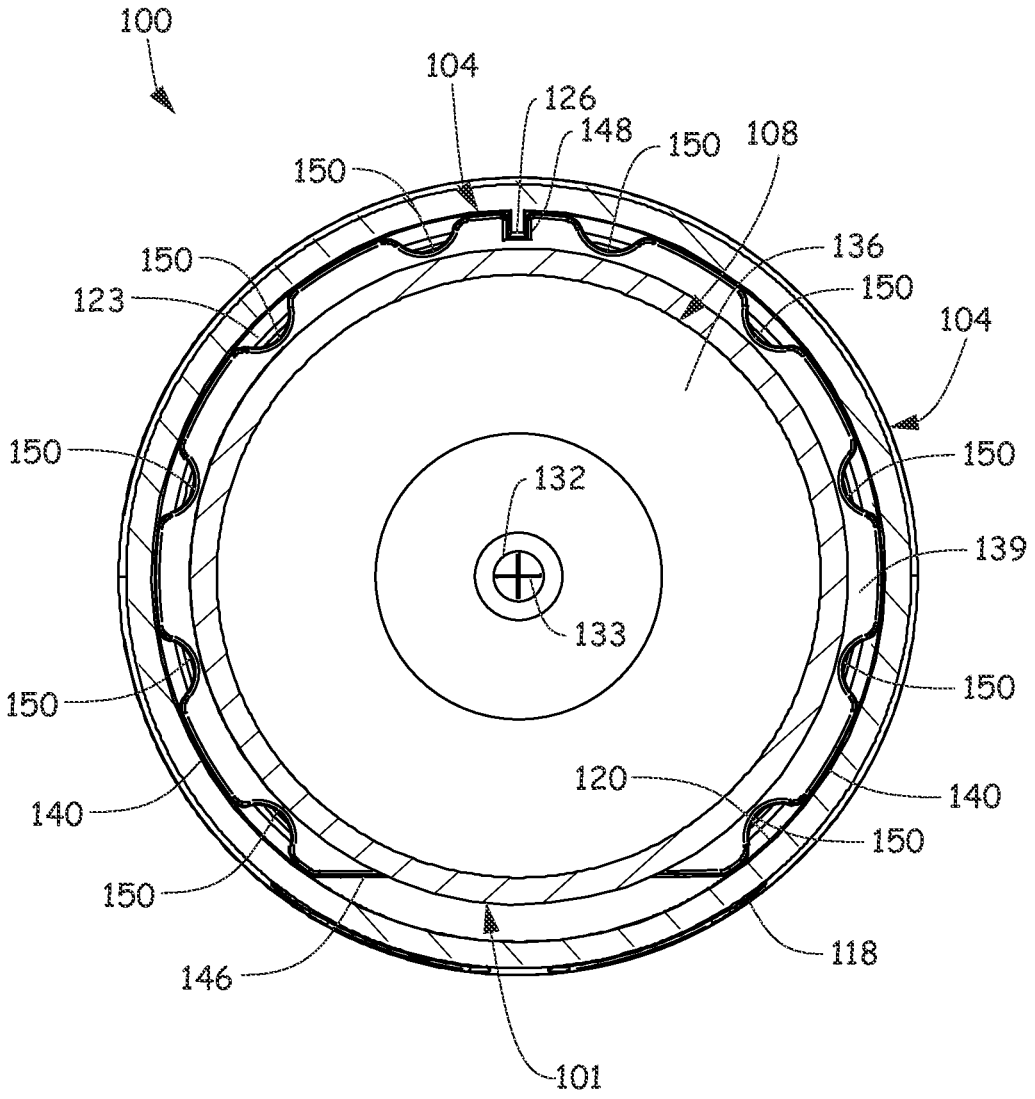
FIG. 24 is an enlarged section view of the spoutless training lid assembly taken through the section line indicated in FIG. 7.

FIG. 22 is a perspective section view of spoutless training lid assembly 100 taken through the section line indicated in FIG. 8. FIG. 23 is a front view of FIG. 22. FIG. 24 is an enlarged section view of spoutless training lid assembly 100 taken through the section line indicated in FIG. 7. As illustrated in FIGS. 22-24, spoutless training lid assembly 100 includes valve 101 inserted inside collar 104 such that plate 139 sits on and engages with upper lip 123 of shelf 122 and outer peripheral edge 134 of gasket 108 seals to upper peripheral rim 116 of collar 104. To insert valve 101, notch 148 in plate 139 engages with guide flange 126 of collar 104 to correctly locate valve 101 inside collar 104. Ribs 145 (not illustrated in FIGS. 22-24) on downward depending flange members 144 engage with or snap-fit with lower lip 125 of shelf 122 to secure valve 101 in place within collar 104. In the resulting insertion position, outer peripheral edge 134 of gasket 108 is in contact with and sealed against rim 116 of collar 104 and at least portions of perimeter edge 140 abut inner wall 120 of collar 104.

FIG. 24 illustrates cut-outs 150 in detail. As illustrated in FIG. 24, when valve 101 is inserted inside collar 104, perimeter edge 140 of plate 139 abuts inner wall 120 of collar 104. In particular, perimeter edge 140 of plate 139 abuts inner wall 120 of upper portion 112 of collar 104. When collar 104 is coupled to vessel 16, cut-outs 150 provide through holes to allow liquid to move from inside vessel 16 to inside the space or cavity between plate 139 of baffle 110, interior facing wall 138 of gasket 108 and inner wall 120 of collar 104 while sippy cup 10 is tilted or inverted. In this space or cavity, liquid will not seep out between outer peripheral edge 134 of gasket 108 and rim 116 of collar 104 unless the seal between outer peripheral edge 134 and rim 116 is broken.

Figure 25:
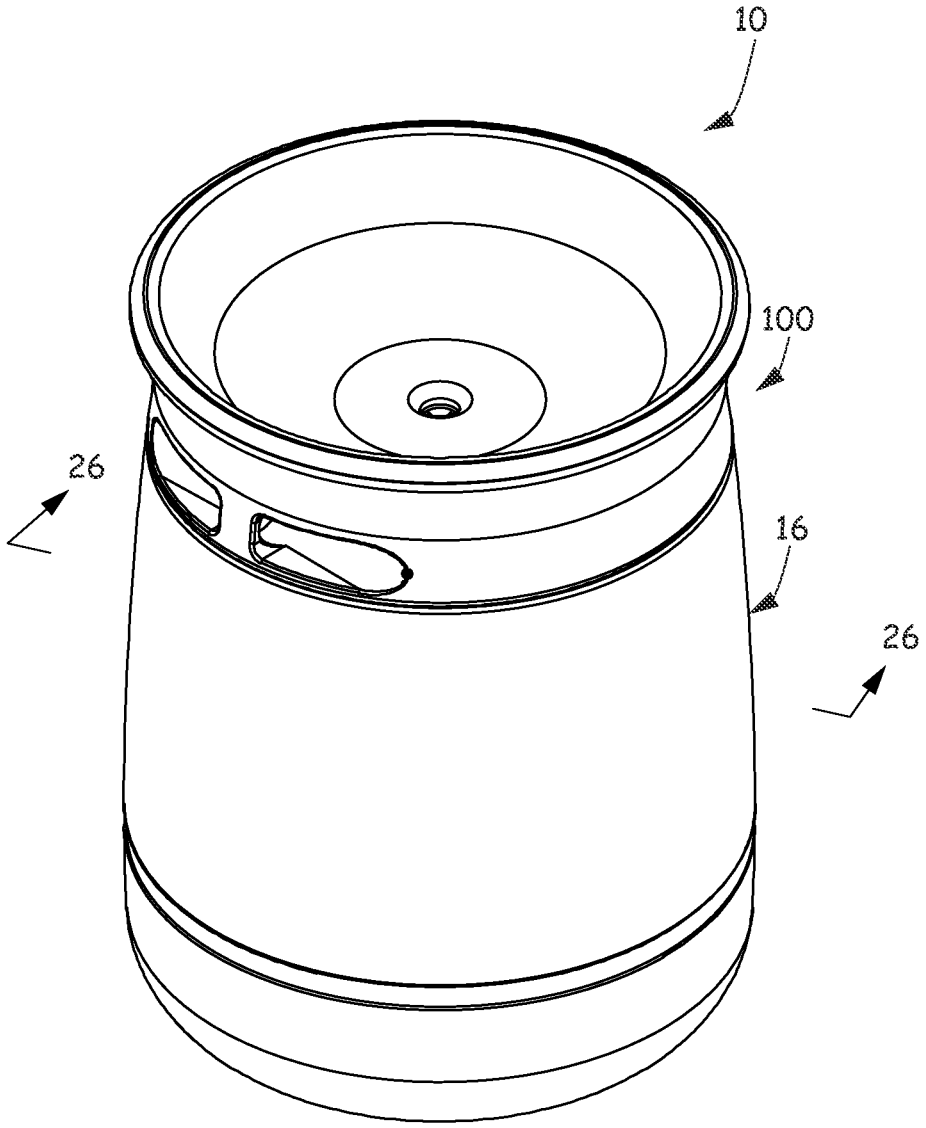
FIG. 25 is a perspective view of the sippy cup of FIG. 1 with the vessel, liquid and spoutless training lid assembly and without the cap and removable base.
Figure 26:
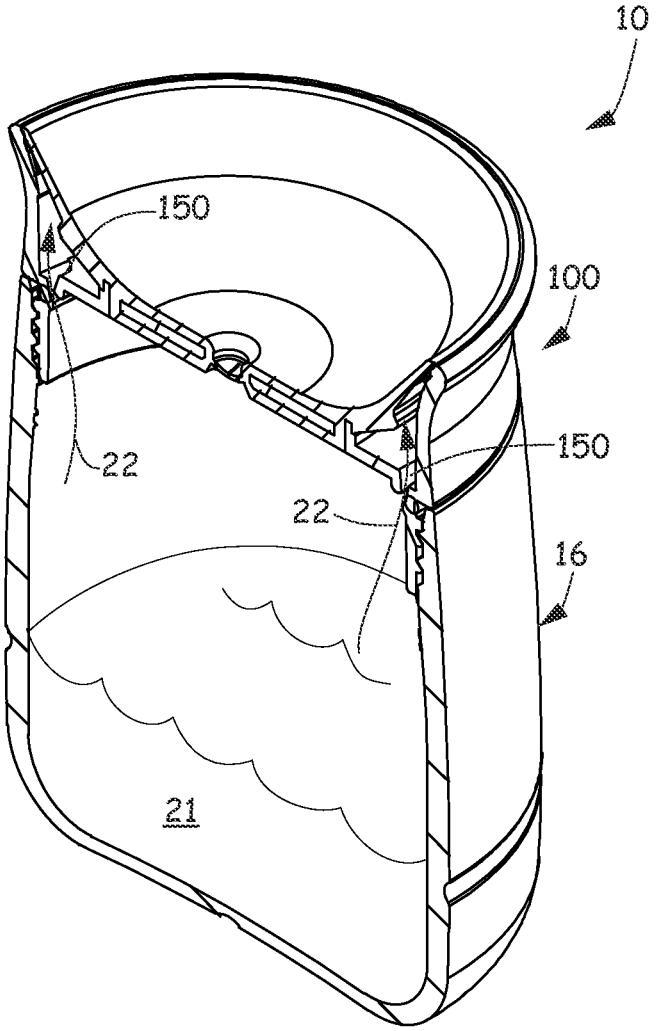
FIG. 26 is the section view of the sippy cup of FIG. 25 taken through the section line indicated in FIG. 25.

FIG. 25 is a perspective view of sippy cup 10 with vessel 16 and spoutless training lid assembly 100 without cap 18 and removable base 12. FIG. 26 is a section view of FIG. 25 taken through the section line indicated in FIG. 25. To use sippy cup 10, spoutless training lid assembly 100 is removed from vessel 16 by unscrewing externally projecting threads 102 on internal portion 114 of collar 104 from internally threaded portion 20 of vessel 16. Liquid 21 is then poured into vessel 16 and spoutless lid assembly 100 is reattached to vessel 16. In this state, sippy cup 10 may be inverted, tilted or otherwise rotated causing liquid 21 to flow through cut-outs 150 (as indicated by arrows 22 in FIG. 26) into the cavity or space between plate 139 and the seal between outer peripheral edge 134 and rim 116. The seal stops liquid 21 from seeping out of sippy cup 10.

Figure 27:
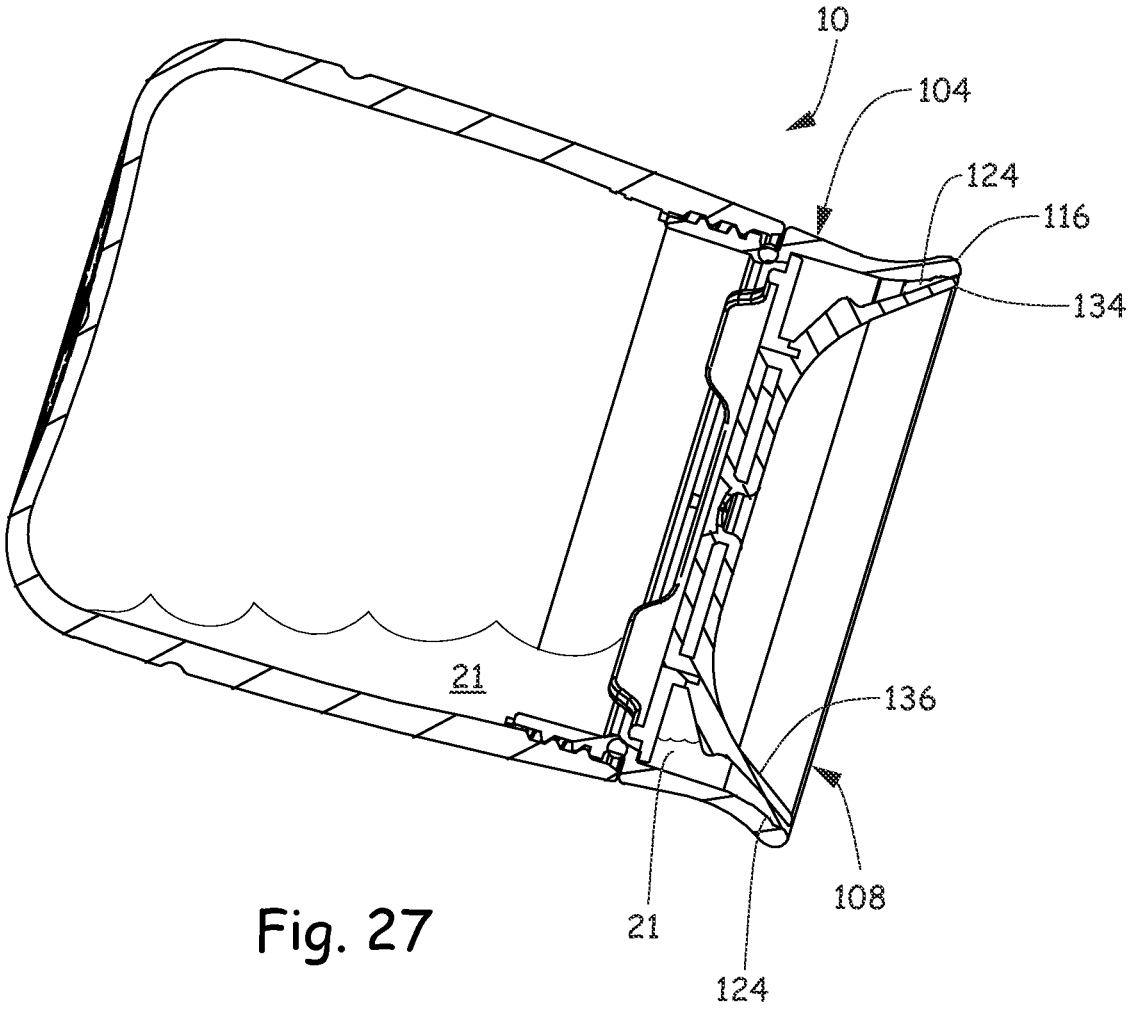
FIG. 27 is the section view of FIG. 26 inverted into a drinking position.

FIG. 27 illustrates FIG. 26 inverted into a drinking position. In this drinking position, a user has placed their mouth (not illustrated) on outer peripheral edge 134 of gasket 108 and rim 116 collar 104 as if on a regular drinking cup and caused a suction force to be applied to exterior facing wall 136 of gasket 108 and therefore lifted outer peripheral edge 134 of gasket 108. With outer peripheral edge 134 lifted, a portion of outer peripheral edge 134 is separated from rim 116 of collar 104 causing that portion to lose its sealing effects and allow liquid 21 that is being channeled between peripheral protrusions 124 inside the cavity or space between plate 139 and rim 116 to pass through into the user's mouth. When the user is finished drinking, they will stop the action of drinking (or creation off a suction force) and move their mouth away from rim 116 of collar 104 thereby allowing the seal to reform between outer peripheral edge 134 and rim 116 of collar 104.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms for implementing the claims.

What is claimed is:

1. A sippy cup having a spoutless training lid assembly, the spoutless training lid assembly comprising:

a collar configured to be coupled to a vessel and having an outer wall, an inner wall, an upper portion configured to be located outside of the vessel and including an upper peripheral rim and a lower portion configured to be located inside of the vessel and including a lower peripheral edge, wherein the collar includes a peripheral shelf located about the inner wall; and a valve inserted into the collar and including a flexible gasket over-molded to a rigid baffle to form a single, separable component, wherein the gasket extends from a plate of the baffle and terminates at an outer peripheral edge that sealably engages with the upper peripheral rim of the collar, and wherein the baffle is secured to the peripheral shelf of the collar and portions of a perimeter edge of the plate of the baffle abut the inner wall of the collar.

2. The sippy cup of claim 1, wherein the spoutless training lid assembly further comprises an external housing located on the outer wall of the upper portion of the collar and includes a through hole, wherein the through hole is configured to receive a clip or tether.

3. The sippy cup of claim 2, wherein the spoutless training lid assembly further comprises a guide flange protruding from the inner wall of the collar positioned opposite from the external housing, wherein the guide flange extends through the peripheral shelf to a terminating end in the upper portion of the collar.

4. The sippy cup of claim 1, wherein the gasket of spoutless training lid assembly comprises a center dimple having intersecting slits to provide a vent between the vessel and an exterior environment.

5. The sippy cup of claim 1, wherein the spoutless training lid assembly further comprises a cylindrical shaft depending downwardly from the plate of the baffle and including a plurality of downward depending flange members spaced apart from each other around a perimeter of the cylindrical shaft, each downward depending flange member includes a rib configured to snap-fit to a lower lip of the peripheral shelf of the collar.

6. The sippy cup of claim 5, wherein the spoutless training lid assembly further comprises a straight edge that extends from a first point on the perimeter edge of the plate of the baffle to a second point on the perimeter edge of the plate of the baffle.

7. The sippy cup of claim 6, wherein the spoutless training lid assembly further comprises a notch in the perimeter edge of the plate of the baffle that is located opposite from the straight edge, the notch being configured to mate with a guide flange that protrudes from the inner wall of the collar.

8. The sippy cup of claim 7, wherein the spoutless training lid assembly further comprises a plurality evenly spaced apart cut-outs in the perimeter edge of the plate located between the first point and the notch and the notch and the second point, wherein the plurality of spaced apart cut-outs are configured to allow liquid to flow from inside the vessel into a cavity between the baffle, the inner wall of the collar and a lower wall of the gasket.

9. The sippy cup of claim 1, wherein the spoutless training lid assembly further comprises a plurality of protrusions that protrude internally from the inner wall of collar and are located between the peripheral shelf and the upper peripheral rim, wherein the plurality of protrusions are configured to guide liquid from a cavity between the baffle, the inner wall of the collar and a lower wall of the gasket towards the peripheral rim of the collar.

10. The sippy cup of claim 1, wherein in response to a user applying a drinking motion with their mouth at a location on the peripheral rim of the collar, the gasket disengages from the peripheral rim at the location to allow liquid to drain from a cavity between the baffle, the inner wall of the collar and a lower wall of the gasket into the mouth of the user.

11. A sippy cup having a spoutless training lid assembly, the spoutless training lid assembly comprising:

a collar configured to be coupled to a vessel and having an outer wall, an inner wall, an upper portion configured to be located outside of the vessel and including an upper peripheral rim and a lower portion configured to be located inside of and including a lower peripheral edge;

a valve inserted into and secured to the collar; and an external housing located on the outer wall of the upper portion of the collar and including a through hole, wherein the through hole is configured to receive a clip or tether.

12. The sippy cup of claim 11, wherein the valve of the spoutless training lid assembly comprises a flexible gasket over-molded to a rigid baffle to form a single, separable component, wherein the gasket extends from a plate of the baffle and terminates at an outer peripheral edge that sealably engages with the upper peripheral rim of the collar, and wherein the baffle is secured to the peripheral shelf of the collar and portions of a perimeter edge of the plate of the baffle abut the inner wall of the collar.

13. The sippy cup of claim 12, wherein the spoutless training lid assembly further comprises a cylindrical shaft depending downwardly from the plate of the baffle and including a plurality of downward depending flange members spaced apart from each other around a perimeter of the cylindrical shaft, each downward depending flange member includes a rib configured to snap-fit to a lower lip of a peripheral shelf on the inner wall of the collar.

14. The sippy cup of claim 12, wherein the spoutless training lid assembly further comprises a straight edge that extends from a first point on a perimeter edge of a plate of the baffle to a second point on the perimeter edge of the plate of the baffle and a notch in the perimeter edge of the plate of the baffle that is located opposite from the straight edge, the notch being configured to mate with a guide flange that protrudes from the inner wall of the collar.

15. The sippy cup of claim 14, wherein the spoutless training lid assembly further comprises a plurality evenly spaced apart cut-outs in the perimeter edge of the plate located between the first point and the notch and the notch and the second point, wherein the plurality of spaced apart cut-outs are configured to allow liquid to flow from inside the vessel into a cavity between the baffle, the inner wall of the collar and an interior facing wall of the gasket.

16. The sippy cup of claim 15, wherein the spoutless training lid assembly further comprises a plurality of protrusions that protrude internally from the inner wall of the upper portion of the collar, wherein the plurality of protrusions are configured to guide liquid from the cavity between the baffle, the inner wall of the collar and the interior facing wall of the gasket towards the upper peripheral rim of the collar.

17. A sippy cup comprising a vessel;

a spoutless training lid assembly coupled to the vessel and having a valve inserted and secured in a collar, the valve including a gasket over-molded to a baffle and an outer peripheral edge of the gasket being sealed to a rim of the collar;

wherein the sippy cup is configured to be tilted so that liquid flows from the vessel through a plurality spaced apart cut-outs in a perimeter edge of a plate of the baffle into a cavity located between a wall of the gasket, the plate of the baffle and an inner wall of the collar; and wherein a drinking force is configured to be applied to the rim of the collar of the spoutless training lid assembly such that the outer peripheral edge of the gasket lifts away from the rim of the collar to allow the liquid to flow from the cavity and out of the sippy cup.

18. The sippy cup of claim 17, further comprising an external housing located on an outer wall of an upper external portion of the collar and includes a through hole, wherein the external housing is configured to receive a clip or tether.

19. The sippy cup of claim 18, wherein the perimeter edge of the plate of the baffle comprises a straight edge that extends from a first point on the perimeter edge of a plate of the baffle to a second point on the perimeter edge of the plate of the baffle and a notch in the perimeter edge of the plate of the baffle that is located opposite from the straight edge, the notch being configured to mate with a guide flange that protrudes from the inner wall of the collar.

20. The sippy cup of claim 1, wherein the gasket comprises a center dimple having intersecting slits to provide a vent between the vessel and an exterior of the sippy cup.

* * * * *